United States Patent [19]

Berger et al.

[11] 4,287,690

[45] Sep. 8, 1981

[54] DOMICAL BUILDING STRUCTURE

[76] Inventors: William R. Berger, 3404 Hawthorne Ave., Richmond, Va. 23222; Benjamin L. Rose, Jr., 220 W. Main St., Richmond, Va. 23220

[21] Appl. No.: 113,947

[22] Filed: Jan. 21, 1980

[51] Int. Cl.[3] ..... E04B 1/32
[52] U.S. Cl. ..... 52/81
[58] Field of Search ..... 52/DIG. 10, 81

[56] References Cited

U.S. PATENT DOCUMENTS 2,440,449 4/1948 Raemer ..... 52/82
3,660,952 5/1972 Wilson ..... 52/DIG. 10

*Primary Examiner*—John E. Murtagh
*Attorney, Agent, or Firm*—Norman B. Rainer

[57] ABSTRACT

A domed structure suitable as an inhabitable dwelling is constructed from triangular panels having abutment surfaces at their sides having continuous interengaging means adapted to insertively mate with adjacent panels to form a self-supporting structure. A specialized base perimeter foundation provides improved stability and facilitates erection of the dome.

8 Claims, 11 Drawing Figures

DOMICAL BUILDING STRUCTURE

BACKGROUND OF THE INVENTION

This invention relates to domical enclosures assembled from polygonal panels which interact to form a substantially self-supporting integral structure.

It is well known that domical buildings enclose a greater volume of space than conventional rectangular structures for an equivalent amount of structural material. Domes also possess a very high strength-to-weight ratio, and high stability because a force applied at any point is resisted throughout the structure.

However, domical structures have not gained wide acceptance in spite of these significant advantages. One of the reasons for this lack of acceptance is the difficulty encountered heretofore in erecting such structures. Most domical structures utilize components which are not easily assembled in the field. Further difficulties have been encountered in causing the dome structure to be sufficiently integral and continuous so as to have a water-tight outer surface acceptable as a roof for outdoor utilization.

Spherically configured dome structures which can be fabricated by the assembly of polygonal panels have been disclosed in numerous references. For example, U.S. Pat. Nos. 2,682,235; 3,197,927 and others to R. Fuller disclose the fabrication of geodesic structures based upon the icosahedron and other geometrical forms that define an enclosed volume. In such geodesic structures, a series of polygonal panels is arranged in continuous abutting relationship such that all vertices are located within a spherical locus. The polygons may be curved, in which case a spherical outer surface is formed, or flat, in which case the resultant outer surface of the structure is faceted or pyramidal. In order to permit use as a dwelling, the structure must be rendered water-impermeable and provided with thermal insulation. Such features are generally found difficult to achieve.

In using flat polygonal panels to construct a volume-enclosing geometric form having a center of symmetry, the greater the number of panels required to complete the form, the closer the outer appearance approaches a spherical shape. This concept may be visualized by contemplation of the series of platonic polyhedrons: tetrahedron, cube, octahedron, dodecahedron and icosahedron, each polyhedron being comprised of an even number of identical flat polygons in abutting juxtaposition wherein the abutment vertices are disposed within a spherical locus, and the center of each polygon is equidistantly spaced from the center of said sphere. As the number of polygons required to complete the volume-enclosing polyhedral surfaces increases, the outward appearance approaches spherical.

A particularly significant manner of approaching sphericity via a multifaceted surface involves the use of an icosahedron wherein each of its twenty triangular faces is further subdivided so as to be comprised of a plurality of smaller triangles, the vertices of which lie within the same spherical locus as the three vertices of the original triangle. The first stage of such subdivision is referred to as a two-frequency icosahedron, and is produced by causing each side of the original triangles to be divided in half, thereby forming four smaller triangles and producing a total surface comprised of eighty triangles. In analogous manner, the icosahedron may be further modified in even higher frequency subdivisions to produce surfaces approaching sphericity comprised of great numbers of relatively small, flat triangular faces.

It has been disclosed in U.S. Pat. Nos. 4,092,810; 3,881,284 and elsewhere that, in assembling panels to form a self-supporting dome having no strengthening or supporting means supplementing said panels, the edges of said panels may have an abutment surface or shoulder enabling adjacent panels to be interconnected at their common edges. Bolts adapted to pass through holes in said shoulders have been disclosed as the preferred fastening means.

U.S. Pat. No. 2,958,918 describes connecting means in the form of paired projections and recesses associated with the edges of building block segments to facilitate their assembly as a domed structure.

The above-mentioned joining techniques, where applied to the fabrication of domed structures from panels, are slow because of difficulties in securing alignment of localized paired fittings or holes. In still further known methods for joining panels, problems that have been encountered include inadequate joint strength, joints that are difficult to render water-tight, requirement of a large number of dissimilar panels, and systems of high cost.

Because of the critical interfitting of panels necessary in fabricating a domed structure, proper placement of the initial panels is important, whether the dome is constructed upwardly from its base or downwardly from its top while suspended by an overhead crane or other temporary means.

The terms "domed" or "domical" as used herein are intended to designate domes, spheres, spherical segments or truncations thereof, and structures of generally rounded appearances whether having a smooth or multifaceted outer contour.

It is an object of the present invention to provide a domed structure which can be easily assembled from a plurality of substantially flat polygonal panels.

Another object of this invention is to provide a domed structure of the aforesaid nature comprised of a small number of dissimilar panels.

A further object of this invention is to provide a domed structure of the aforesaid nature possessing sufficient strength, water-imperviousness and thermal barrier characteristics to be useful as an inhabitable outdoor building.

A still further object of this invention is to provide a domed structure of the aforesaid nature which is improved with respect to ease of construction upwardly from its base.

These objects and other objects and advantages of the invention will be apparent from the following description.

SUMMARY OF THE INVENTION

The above and other beneficial objects and advantages are accomplished in accordance with the present invention by the provision of an improved domed structure comprising a base perimeter foundation and a dome built thereupon.

Said dome is comprised of triangular panels having a substantially flat outer face and provided at each edge with an abutment surface having therein continuous interengaging means such as a groove or projection extending the full length of the edge and adapted to insertively mate with a corresponding projection or groove respectively in the edge of an adjacently placed panel. The abutment surface is disposed below said outer face as a continuous integral portion of said panel. The thickness and composition of the panel is selected so as to provide thermal barrier characteristics while minimizing weight, said features being achieved preferably by fabrication from a cellular polymeric composition. As a consequence of their critical manner of construction, said panels can be interfitted by individuals without mechanical assistance or fastening devices to form a self-supporting, thermally efficient and weather-resistant dome. One of the plurality of triangular panels, intended to be positioned at the top of the dome, is provided with a modified interengaging means which does not require insertive mating.

Said base perimeter foundation is comprised of a plurality of two styles of angled footings. Each footing is comprised of two straight opposed segments of equal length meeting at a central vertex, the length of each segment being half the length of an edge of said triangular panels. The upper portion of each segment is provided with continuous interengaging means of the same nature as employed on said panels, the configuration of interengaging means on one segment being the complementary mating configuration of interengaging means on the opposite segment. The two styles of footings have opposite arrangements of interengaging means in each segment such that, when placed in alternating end to end abutment to form a closed polygonal perimeter, the footings provide a series of interengaging means of alternating configuration adapted to receive edges of said panels in a manner whereby each edge of said panels spans two segments of adjacent footings. Such manner of construction of said base perimeter foundation not only facilitates the placement of the first row of panels, but causes an interlocking of said foundation by said panels.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
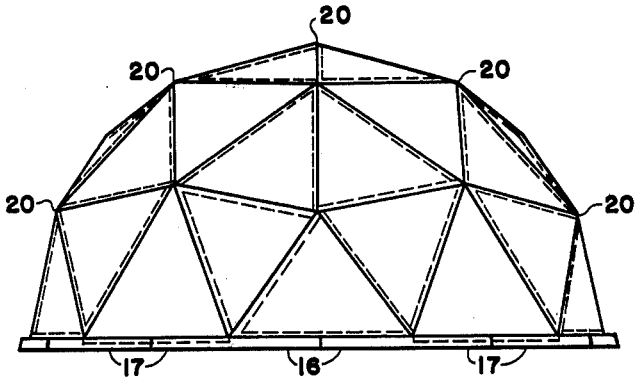
FIG. 1 is an exterior elevation of an embodiment of a domed structure of this invention.
Figure 2:
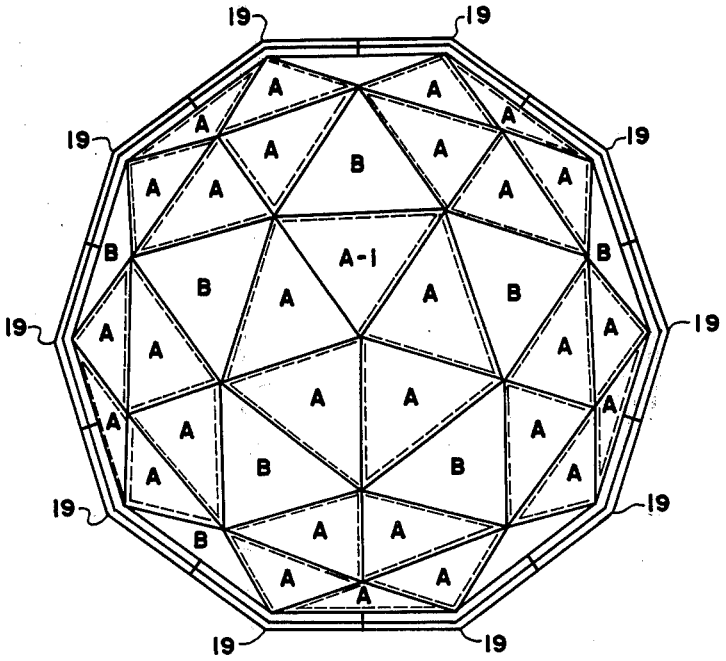
FIG. 2 is a top plan view of the structure of FIG. 1.
Figure 3:
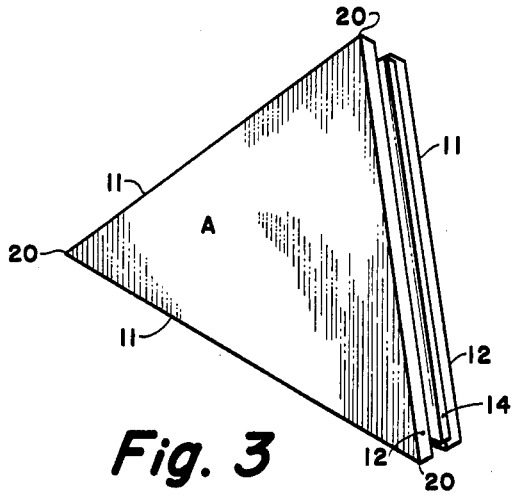
FIG. 3 is a perspective view of a triangular panel employed in the fabrication of the structure of FIG. 1.
Figure 4:
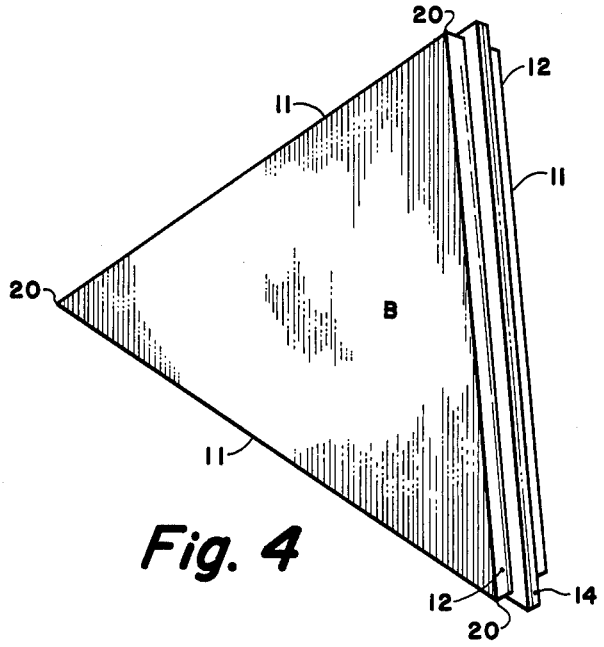
FIG. 4 is a perspective view of another triangular panel employed in the fabrication of the structure of FIG. 1.
Figure 9:
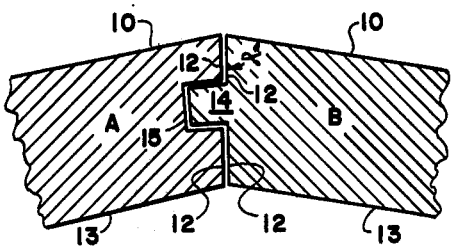
FIG. 9 is an enlarged sectional fragmentary view showing the mating of two panels.

Referring to FIGS. 1 and 2, the domed structure illustrated is essentially a half-sphere icosahedron of two-frequency breakdown fabricated from isosceles triangular panels A and equilateral triangular panels B. The vertices 20 of said triangles lie on a spherical locus, and the lines of abutment of said panels lie in a plane containing the center of said sphere. As shown in FIGS. 3, 4 and 9, each panel is comprised of an upper face 10 having vertices 20, lower face 13, edges 11, and side abutment surfaces 12 having a continuous tongue projection 14 or groove 15 adapted to receive and conform with said tongue projection.

In the assembled dome of FIGS. 1 and 2, the dotted lines indicate the locations where the tops of tongues 14 interface with the bottoms of grooves 15. In the particular embodiment illustrated, of the two equal length edges of isosceles panels A, one edge is provided with a tongue 14 and the other is provided with a groove 15. The base edge of said isosceles triangle is provided with a groove 15. The equilateral triangular panels B are provided with tongues 14 at all three edges. In other embodiments of panels useful within the preview of the present invention, the tongues and grooves may be arranged in different relationships. It is important to note that the nature of the interlocking provided by the tongue and groove interengaging means of the panels is such as to prevent motion of the engaged panels in directions perpendicular thereto but permits sufficient sliding motion to facilitate accurate positioning. Although the exemplified tongue projection is shown to be square-shouldered, other configurations may also be utilized such as tapered or rounded, with correspondingly shaped grooves. Preferably, however, the projection will have a plane of symmetry perpendicular to abutment surface 12. The height of the tongue, measured from abutment surface 12 will generally be between about ½ and 2 inches so that thermal contraction will not cause disengagement of the panels.

The abutment surfaces 12 associated with each edge of said panels form an acute angle $\alpha$, shown in FIG. 9, in going from outer face 10 to inner face 13. Although the exact value of angle $\alpha$ will depend upon the particular embodiment of dome structure chosen, its value will generally range from about 78° to 86°. Except for the interengaging means generally centered within the abutment surfaces, said abutment surfaces are preferably flat. The length of the abutment surface measured between outer and inner faces should be adequate to permit the interengaging means to be dimensioned for acceptable strength.

Figure 10:
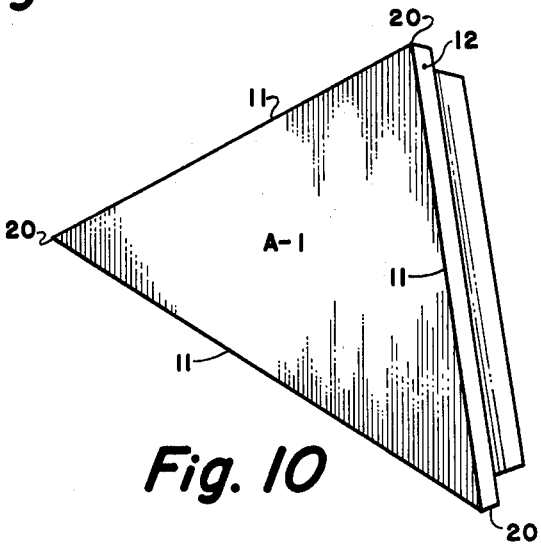
FIG. 10 is a perspective view of the top panel of said dome which does not require insertive mating with other panels.
Figure 11:
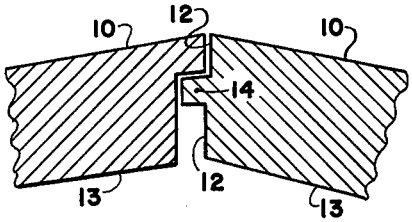
FIG. 11 is an enlarged sectional fragmentary view showing the mating of the panel of FIG. 10 with other panels.

Because of the special construction of the dome of the present invention involving the insertive engagement of a plurality of panels, the last panel to be laid in place, namely top panel A-1 shown in FIG. 10, requires a non-insertive means for interengaging with the other panels. This is accomplished by modifying one of the isosceles panels A such that, instead of the receiving groove on two edges thereof, said edges are rabbetted as shown in FIG. 10 to facilitate the "drop-in" assembly shown in FIG. 11, thereby completing the domical enclosure.

Although the panels described hereinabove provide a self-supporting structure by virtue of their novel interfitting characteristics, bonding agents may be applied to the joints between panels during or after assembly of the dome structure. Said bonding agents may be in the nature of sealants, caulks or adhesives which promote interbonding of the panels and seal any openings through which water may pass. Such bonding agents are flowable compositions which will harden and adhere to said panels. Exemplary bonding agents include silicones, polysulfides, polybutenes and other resinous materials which may be applied as solvent-based or hot-melt compositions, and solutions containing polymeric material from which said panels may be fabricated.

The panels of the present invention are preferably fabricated from polymeric materials by molding or casting methods. Thermoplastic polymeric materials which may be utilized include polyacrylates such as polymethylmethacrylate and its copolymers with other vinyl monomers; polycarbonates such as those derived from bisphenol A; polyamides such as nylon 6, nylon 66 and nylon 11; polyphenylene sulfide; cellulosic esters such as cellulose acetate and cellulose butyrate; polystyrene and its copolymers with vinyl monomers such as acrylonitrile and butadiene; polyvinylchloride and its copolymers with other vinyl monomers; polyesters such as polyethylene terephthalate and polybutylene terephthalate; polypropylene and its copolymers with other vinyl hydrocarbons such as 4 methyl 1 pentene; ionomers which are mixtures of interacted ionic polymers; polyacetals such as polymers and copolymers of formaldehyde; and other equivalent compositions. Thermosetting polymeric materials which may be utilized in the fabrication of said panels include phenol-formaldehyde resins, epoxide resins, isocyanate cross-linked polyurethanes, styrene resins cross-linked with divinyl benzene, reactive polyesters containing maleic anhydride, N-methylol polyacrylates, and equivalent compositions.

Whereas thermoplastic resins may permit the injection molding of the panels, thermoset resins may require casting techniques from monomers or reaction-injection molding techniques utilizing catalyzed monomers or prepolymers.

Various filler materials may be incorporated into the polymer composition for the purpose of reducing cost, increasing strength or decreasing thermal conductivity. Strengthening fillers include fibrous reinforcing materials such as fiberglass, carbon, alumina, metal and aramid, and non-fibrous materials such as mica. Cost-reducing extenders include clays, silicas, glass, cork, perlite, wood flour, calcium carbonate, talc, and equivalents thereto. The use of "microbaloons," small hollow spherical particles, may reduce cost and weight of the composition while decreasing its thermal conductivity.

Some of the panels utilized in the dome structure may be modified so as to have a transparent region for admitting light, or hinged so as to controllably permit passage of air.

The panels of this invention preferably have a thermal transmission factor R between $1\times10^{-5}$ and $2\times10^{-4}$ cal/sec-cm$^2$-°C. wherein R may be defined by the equation $R=K/L$ where $K=HL/A\Delta t$ wherein K is the coefficient of thermal conductivity, H is the rate of heat transfer, L is the thickness of the panel, A is the unit area, and $\Delta t$ is the thermal gradient across the panel.

In order to achieve the insulative characteristics indicated by said R value, the panels are preferably made to contain a cellular structure, preferably closed cells entrapped within the polymer structure. The production of cellular or foamed shaped polymer structures may be achieved by use of known techniques which incorporate or generate gas bubbles while the initially fluid polymer undergoes solidification. One such method involves the use of azide-type blowing agents which release nitrogen at specific temperatures. Said cellular morphologies are preferably of the closed cell type, as opposed to open-celled varieties. Other cellular configurations which may, however, be utilized in the construction of said panels include various known honeycomb structures.

Figure 5:
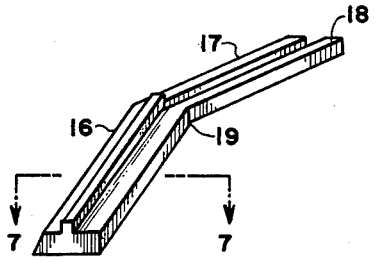
FIG. 5 is a perspective view of one style of angled footing employed in the fabrication of the structure of FIG. 1.
Figure 6:
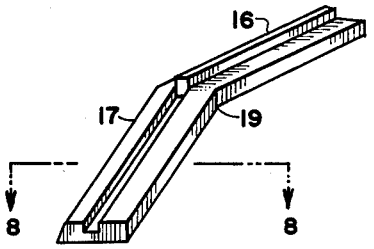
FIG. 6 is a perspective view of a second style of angled footing employed in the fabrication of the structure of FIG. 1.
Figure 7:
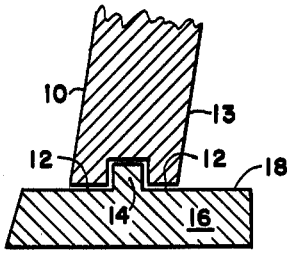
FIG. 7 is a sectional view taken along the line 7—7 of FIG. 5 showing a fragmentary view of a panel seated on said footing.
Figure 8:
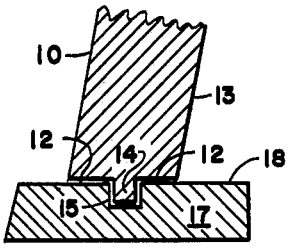
FIG. 8 is a sectional view taken along the line 8—8 of FIG. 6 showing a fragmentary view of a panel seated on said footing.

FIGS. 5 and 6 illustrate the two styles as angled footings. When five each of these footings are alternately abutted end to end as shown in FIGS. 1 and 2, they define the base perimeter foundation of the domed structure. Each angled footing contains both a tongue and a groove engaging means on opposed segments 16 and 17 respectively, each segment being half the length of an edge of the triangular panels. When placed together, two adjoining segments 16 or 17 form a tongued or grooved engaging means of the same length as an edge of a panel. When so arranged, said footings can accommodate the first row of panels as shown in FIGS. 7 and 8 by mating the abutment surfaces of said panels with the upper surface 18 of said footings, said upper surface forming a horizontal coplanar ring with joints centered within the edges of the panels of said lowermost row. It is particularly important to note that the vertices 20 of the panels of said lowermost row are positioned at the angled center 19 of said footings. Such manner of arrangement locks both panels and footings into a dimensionally stable structure.

Although the present specification has described the use of substantially flat panels, the same inventive concepts may be applied to curved panels. For further strengthening and weather-proofing of the dome, end caps may be applied to the exterior surface at the confluence points of vertices of the triangular panels.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A domed structure comprising a base perimeter foundation and a dome positioned thereupon, said dome being comprised of a plurality of triangular panels having a flat outer face and having adjacent each side a flat abutment surface having therein continuous interengaging means in the form of a groove or projection uniformly extending substantially the full length of said side and adapted to insertively mate with a corresponding projection or groove respectively associated with the side of an adjacently positioned interengaged panel in a manner to prevent motion of the interengaged panels in directions perpendicular thereto, said abutment surfaces being disposed below said outer face forming an angle therewith of between about 78° and 86°, the thickness and composition of said panels being selected so as to provide rigidity and thermal barrier characteristics while minimizing weight, and one triangular panel intended for positioning generally adjacent the uppermost portion of said dome as the last panel in the construction thereof, said last panel having interengaging means which do not require insertive mating and being otherwise identical to said plurality of panels, said base perimeter foundation being comprised of a plurality of footings of two different styles, each footing having two opposed straight segments, the length of each segment being half the length of a side of at least some of the panels, the upper portion of each segment being provided with interengaging means of the same general nature as employed in said plurality of panels, the configuration of interengaging means on one segment being the complementary mating configuration of interengaging means of the opposite segment of each footing, the two styles of footings having opposite arrangements of interengaging means in each segment such that, when placed in alternating end to end coplanar abutment to form a closed polygonal perimeter, the footings provide a series of interengaging means of alternating configuration adapted to receive sides of said panels in a manner whereby each side of said panels spans two segments of adjacent footings.

2. The domed structure of claim 1 wherein each vertex of said triangular panels is positioned within a spherical locus and the lines of abutment of the sides of adjacent panels lie in a plane containing the center of said sphere.

3. The domed structure of claim 1 wherein a bonding agent is applied to the sides of said panels and said dome is impervious to water.

4. The domed structure of claim 1 wherein said panels are comprised of polymeric material capable to being shaped by molding or casting techniques and contain closed cellular spaces.

5. The domed structure of claim 4 wherein said panels have a thermal transmission factor between $1\times10^{-5}$ and $2\times10^{-4}$ cal/sec-cm$^2$-°C.

6. The domed structure of claim 1 wherein said interengaging means have a plane of symmetry perpendicular to said abutment surface.

7. The domed structure of claim 1 wherein, by virtue of the nature of said footings and said panels, said dome can be assembled upwardly from said base perimeter foundation.

8. The domed structure of claim 1 based upon an icosahedron and wherein said plurality of panels is comprised of not more than two different triangular panels.

* * * * *